United States Patent [19]

Theurer et al.

[11] Patent Number: 4,556,112

[45] Date of Patent: Dec. 3, 1985

[54] MOBILE CONVEYOR ARRANGEMENT

[75] Inventors: Josef Theurer, Vienna; Manfred Brunninger, Linz, both of Austria

[73] Assignee: Franz Plasser Bahn-baumaschinen-Industriegesellschaft m.b.H., Vienna, Austria

[21] Appl. No.: 558,937

[22] Filed: Dec. 7, 1983

[30] Foreign Application Priority Data

Dec. 29, 1982 [AT] Austria ..... 4729/82

[51] Int. Cl.[4] ..... E01B 27/10; D02F 3/08

[52] U.S. Cl. ..... 171/16; 37/208; 198/577; 198/550.01

[58] Field of Search ..... 171/16; 37/208, 104–107; 104/7 R, 7 B, 2, 12; 172/33; 198/616, 577

[56] References Cited

U.S. PATENT DOCUMENTS

| | | | |
|---|---|---|---|
| 1,476,882 | 12/1923 | Forsyth | 198/577 |
| 2,787,389 | 4/1957 | Walters | 171/16 X |
| 2,791,410 | 5/1957 | Allemann | 171/16 |
| 3,126,653 | 3/1964 | Bourgeous | 172/33 X |
| 3,370,695 | 2/1968 | Robson | 198/577 |
| 3,685,589 | 8/1972 | Plass er et al. | 171/16 |
| 4,135,631 | 1/1979 | Theurer et al. | 141/339 |
| 4,253,256 | 3/1981 | Feliz | 37/104 |
| 4,450,771 | 5/1984 | Theurer et al. | 37/104 X |

FOREIGN PATENT DOCUMENTS 1067465 5/1967 United Kingdom .

*Primary Examiner*—Richard J. Johnson
*Attorney, Agent, or Firm*—Kurt Kelman

[57] ABSTRACT

A conveyor arrangement for bulk material is mounted on a track for mobility therealong in an operating direction and comprises a longitudinally extending track-bound vehicle and a conveyor arranged on the vehicle for receiving the bulk material. The conveyor has a bulk material storage and conveyor band and a controllable drive for the conveyor band whereby conveyance of the bulk material on the conveyor band may be selectively shut off or controlled for temporary storage of the bulk material thereon.

5 Claims, 3 Drawing Figures

MOBILE CONVEYOR ARRANGEMENT

The present invention relates to a conveyor arrangement for bulk material, the conveyor arrangement being mounted on a track for mobility therealong in an operating direction and comprising a track-bound vehicle extending longitudinally in this direction and a conveyor means arranged on the vehicle for receiving the bulk material and extending in this direction. This arrangement is disclosed as particularly useful in a ballast cleaning machine comprising means for excavating ballast supporting the track and for separating the excavated ballast into a cleaned ballast component and a waste material component. In such a machine, the conveyor means is arranged to receive the waste material as the bulk material, and a station including a container for the waste material component may be arranged to receive the waste material component discharged from the conveyor means or the waste material component may be discharged by a discharge conveyor.

A ballast cleaning machine with a waste material disposal of this general type has been disclosed in U.S. Pat. No. 3,685,589, dated Aug. 22, 1979. The waste material conveyor of this machine comprises a continuously driven, elongated conveyor band having an input end receiving the waste material from a ballast screening arrangement and moving past the operator's cab of the machine to a front end of the machine, the output end of the conveyor band at the machine front end depositing the conveyed waste material on a discharge conveyor. The discharge conveyor is mounted on the front end for lateral pivoting to either side of the track and its speed may be so adjusted that the waste material is thrown by centrifugal forces to a respective side of the track through an adjustable discharge path, depending on the speed of the discharge conveyor, or into a freight car coupled to the front end of the machine. An additional waste material conveyor is arranged for selectively receiving waste material from the ballast screening arrangement and conveying it to a rear end of the machine where it may be loaded onto freight cars coupled to the machine rear end. This arrangement enables the waste material to be selectively loaded into the front and/or rear freight car when the speeds of the waste material conveyor band and of the discharge conveyor are substantially synchronized or to discharge the waste material by the laterally pivoted discharge conveyor operated at a much higher speed than the conveyor band at a respective side of the track where it may be simply deposited next to the track shoulder or on freight cars running on a parallel track. This waste material conveyor arrangement is quite adaptable to various operating conditions and, therefore, has been commercially very successful. In electrified track sections, the waste material is usually deposited on that side of the track along which the electric poles are arranged. When the laterally pivoted discharge conveyor approaches such a pole, it is pivoted back into its centered position to assure proper passing of the machine without damage to the pole. It is unavoidable in this operation that one or the other of these electric poles, which passingly is within the discharge range of the rapidly driven discharge conveyor as the machine passes the poles, is surrounded by too much waste material. At any rate, deposition of the waste material in the immediate vicinity of the electric poles is undesirable because this may hinder control and maintenance work at such a pole.

U.S. Pat. No. 4,135,631, dated Jan. 23, 1979, discloses a freight train for receiving, transporting and discharging bulk material, such as waste material from a ballast cleaning machine. This train comprises a succession of flat cars and a plurality of transport containers for the bulk material arranged on each car loading platform in succession in the direction of the track. A mobile crane grips respective containers and drives them selectively to and from loading and storage stations on the flat cars whereby successive containers may be loaded with the bulk material and the loaded containers may be stored on the platforms of the cars. This installation has also been highly successful in ballast cleaning operations, providing high efficiency and substantially continuous work since the loaded cars may be uncoupled and replaced by empty cars without interruption of the ballast cleaning operation. However, the movements of the gantry cranes must be carefully synchronized so that the movement of the containers always conforms to the amount of the delivered waste material, which is difficult if these amounts vary considerably.

British Pat. No. 1,067,465, published May 3, 1967, discloses a ballast cleaning machine comprising a conveyor for conveying waste material from the ballast cleaning screen to a chute which deposits the waste on an ascending discharge conveyor band at the front of the machine. The chute serves to guide the waste material to a hopper from which the discharge conveyor band removes the material.

It is the primary object of this invention to provide a mobile conveyor arrangement of the first-described type, which simply and dependably solves various practical problems encountered in the handling of waste material in ballast cleaning machines.

The above and other objects are accomplished according to the invention with a conveyor means comprising a bulk material storage and conveyor band and a controllable drive for the conveyor band whereby conveyance of the bulk material on the conveyor band may be selectively controlled or shut off for temporary storage of the bulk material thereon or for conveyance at a controlled speed.

With this surprisingly simple arrangement, it has become possible for the first time to interrupt the bulk material conveyance temporarily or to slow it down to a desired extent while continuing all other operative functions of the machine, either by stopping the drive entirely or by suitably reducing its speed whereby the material may be temporarily stored on the conveyor band. This increases the operating possibilities of the machine considerably and provides conditions enabling the machine to execute operations which heretofore were very difficult to accomplish rapidly, dependably and with reduced operating costs. For instance, in the above-described ballast cleaning operations in electrified track sections, the discharge of the waste material coming continuously from the ballast cleaning screen may be interrupted when an electric pole or another object to be kept free of being surrounded by waste material, such as a signal mast, a bridge embankment or the like, comes into the range of the waste material discharge end of the conveyor band. In this manner, the ballast cleaning operation may be continued uninterrupted while the area surrounding such an object may be kept free of waste material and any damage thereto is dependably avoided in a very simple manner.

Furthermore, the construction of the conveyor arrangement in accordance with the invention also enables variations in the waste material amount to be equalized by so changing the drive speed of the storage and conveyor band that a station including a container arranged to receive the waste material discharged from the conveyor band receives a continuous, uniform flow of the material and a trouble-free loading of the container is thus assured. This makes it possible to do away with heavy storage hoppers at such a station.

This assured continuity of the waste material removal under difficult operating conditions increases the efficiency and economy of ballast cleaning machines equipped with such a conveyor arrangement, which is of particular importance in track renewal trains since the efficiency and operating dependability of such trains are functions of these factors in each machine forming part of the train. The structural requirements are so simple that existing conveyor arrangements may be readily retrofitted in accordance with the invention without causing any technical problem.

The above and other objects, advantages and features of the present invention will become more apparent from the following detailed description of a now preferred embodiment thereof, taken in conjunction with the accompanying, somewhat schematic drawing wherein FIG. 1 is a side elevational view of a ballast cleaning machine equipped with a bulk waste material conveyor arrangement according to this invention;

Figures 1, 2, 3:
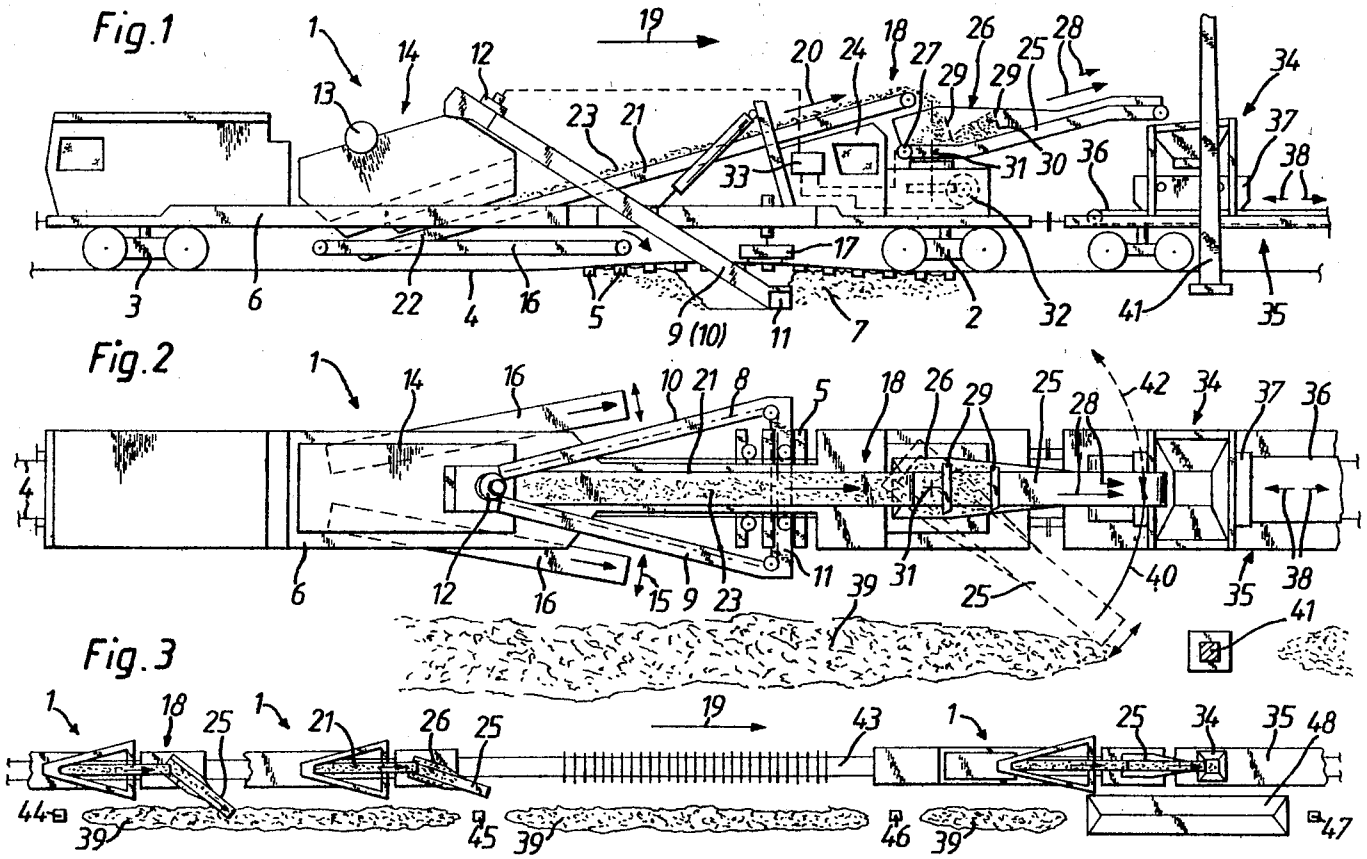
FIG. 2 is a top view of FIG. 1.
FIG. 3 is a schematic top view of an electrified track section in which the machine of FIGS. 1 and 2, shown on a smaller scale, is operated.

Referring now to the drawing and first to FIGS. 1 and 2, there is shown ballast cleaning machine having frame 6 mounted on swival trucks 2, 3 on a track consisting of rails 4 fastened to ties 5 for mobility therealong in an operating direction indicated by arrow 19. The frame constitutes a track-bound vehicle extending longitudinally in this direction. As is quite conventional and shown, for example, in U.S. Pat. No. 3,685,589, the machine comprises means for excavating ballast 7 supporting the track, the illustrated ballast excavating means comprising endless excavating and conveyor chain 8 running in a trianglular guide comprised of two elongated guide sections 9, 10 inclined to the track plane and transverse guide section 11 connecting the lower ends of the elongated guide sections and extending in the ballast bed under the track plane. Dredger drum drive 12 is arranged at the top of the chain for driving the same and the chain is equipped with excavating fingers digging into the ballast for excavating the same when the chain passes along transverse guide section 11 and for conveying the excavated ballast upwardly along guide section 10 whence it is discharged onto screening means 14 for separating the excavated ballast into a cleaned ballast component and a waste material component. The screening means, too, is entirely conventional and is comprised of a screening arrangement vibrated by drive 13. Two conveyor bands 16, 16 have input ends arranged under the screening arrangement to receive the cleaned ballast component therefrom. The conveyor bands are arranged in alignment with the two track rails and are laterally pivotal for reciprocation in the directions of double-headed arrows 15 to distribute the cleaned ballast component in the excavated ballast bed portion below the track lifted by track lifting unit 17.

A conveyor means is arranged on vehicle 6 for receiving the bulk waste material component from the screening arrangement and this conveyor means extends in the operating direction indicated by arrow 19. The illustrated conveyor means comprises elongated conveyor 18 extending in the direction of arrow 19 from screening arrangement 13, 14 towards the front of the vehicle in that direction. This conveyor comprises conveyor band 21 continuously operated at a substantially constant speed and having input end 22 under the screening arrangement for receiving waste material 23 therefrom. The conveyor band rises towards the front of the vehicle above operator's cab 24. According to this invention, the conveyor means further comprises bulk material storage and conveyor band 25 with a controllable drive 27 for this conveyor band whereby conveyance of waste material 23 on conveyor band 25 may be selectively shut off or controlled for temporary storage of the waste material thereon. Conveyor band 25 has an input end for receiving the waste material from conveyor 18 and an output end for discharging the waste material. In the illustrated embodiment, the input end of conveyor band 25 is shaped as storage container 26 open on top and in the direction of conveyance, continuously driven conveyor band 21 being arranged to feed waste material 23 to this conveyor band end. The illustrated storage container has upwardly diverging walls.

In this arrangement, the conveyor band itself forms the bottom of the storage container or hopper which need only have sufficient capacity to store about 1 to 2 cubic meters of bulk material to meet the operational requirements encountered in practice. Therefore, not much more space, particularly in a vertical direction, is needed for this arrangement than has been provided in conventional conveyors for this purpose so that all the usual dimensional requirements may readily be met with this arrangement according to the invention.

Arrows 28 illustrate the control of drive 27 to achieve any desired speed between a miximum speed for conveyor band 25 and reduction of the speed to zero, i.e., stopping the movement of the conveyor band entirely.

According to the illustrated preferred embodiment, one or more bulkheads 29 extend transversely to the conveyance direction in storage container 26, each bulkhead having lower edge 30 spaced from conveyor band 25. This spacing determines the maximum height or profile of the bulk material removed from the storage container by conveyor band 25 when drive 27 is started or its speed increased. In this manner, the flow of the material towards the output end of the conveyor band is made uniform and is held within predetermined limits.

Substantially vertical pivot 31 supports the input end of conveyor band 25 on vehicle 6 and drive 32 pivots the conveyor band about the pivot whereby the conveyor band output end is displaced laterally in the directions of arrows 40, 42 for discharging the bulk material laterally of the track. Pivoting drive 32 may be a worm drive operated by a hydraulic motor. The pivoting drive as well as drive 27 for conveyor band 25 are connected to control panel 33 in cab 24 and dredger drum 12 is also connected thereto to enable the operator in the cab to actuate these drives.

This arrangement has the great advantage of combining in conveyor band 25 the functions of an intermediate bulk mateial storage device with those of selectively discharging the material at either side of the track, at a forwardly arranged loading station running on the track or on freight cars running on a neighboring track. Since the speed of the drive is controllable, it may be readily changed to obtain the desaired discharge paths at the output end whose shapes depend on the differences in the centrifugal forces generated by the conveyor speed. In this manner, the distance at which the waste material is discharged may be regulated. Such an arrangement may be quite readily retrofitted on a ballast cleaning machine which is already equipped at the front end with a pivotal waste material discharge conveyor, as shown in U.S. Pat. No. 3,685,589.

In the illustrated embodiment, station 34 including container 37 for the waste material is arranged to receive the waste material discharged from conveyor band 25 when the latter is in its centered position shown in full lines in FIG. 2. Station 34 is supported in track-bound vehicle 35 coupled to the front end of ballast cleaning machine 1. This vehicle belongs, for example, to the type of freight train disclosed in U.S. Pat. No. 4,135,631 and carries transfers conveyor 36 for conveying a series of waste material containers 37 between the loading platforms of the flat cars forming this freight trains and loading station 34. As shown by arrows 38, conveyor 36 may be selectively driven in opposite directions to bring empty containers 37 to the loading station and take the filled containers from this station.

This arrangement is of particular advantage in use with very long, high-efficiency ballast cleaning machines whose elongated frame may be articulated and supported on a series of swivel trucks since it enables the conveyor arrangement to bridge a relatively large distance between its receiving input end and its discharging output end. More particularly, it makes it possible to guide the conveyor to the discharge and loading station above the operator's cab and other superstructures on the machine frame. If, as hereinabove described, the waste material storage and conveyor band of the invention is integrated in the conveyor arrangement in such a manner that it may be laterally pivoted from a centered position, the waste material may be alternatively disposed at the sides of the track or it may be loaded into successive containers 37 at station 34.

In the swung-out position of storage and conveyor band 25 shown in broken lines in FIG. 2, elongated conveyor band 21 is continuously driven to discharge waste material 23 into container 26 at the input of conveyor band 25 and the latter is driven at substantially the same speed as conveyor band 21 to throw the waste material off the outer end of conveyor band 25, thus forming continuous waste dump 39 alongside the track. The lateral distance of waste dump 39 from the track may be adjusted in a relatively wide range by changing the pivoting angle of conveyor band 25, on the one hand, and/or the speed of conveyor band drive 27, on the other hand, which determines the centrifugal force and, therefore, the parabolic path of the waste material thrown off the conveyor band end. In this manner, the operation of the conveyor arrangement may be readily adapted to the prevailing operating conditions and available space. When ballast cleaning machine 1, which moves continuously in the direction of arrow 19, approaches a point where a fixed object, such as electric pole 41 in an electrified track section, is in the range of the discharge end of laterally pivoted conveyor band 25, the conveyor band is swung back towards its centered position sufficiently to avoid a collision between the object and the conveyor band discharge end. At the same time, it is desirable or may even be required to avoid any deposit of the waste material in the immediate neighborhood of object 41 because stones or other substances in the waste material may damage the object and the waste material deposit may prevent ready access to the object for control or maintenance work. Conveyor band drive 27 is then switched off so that no waste material is discharged from the conveyor band and waste material 23 continuously delivered into container 26 of conveyor band 25 is temporarily stored while all other operations of machine 1 continue uninterrupted. After object 41 has been passed, conveyor band is swung out again by drive 32 and drive 27 is switched on to resume the discharge of the waste material instantaneously to form another continuous waste dump alongside the track.

Conveyor band drive 27 and pivoting drive 32 are connected to control element 33 in the operator's cab so that the conveyor band drive may be switched on or off in response to the lateral displacement of the conveyor band. For example, the switching may be alternately actuated when the pivoting drive is reversed. The storage function in the centered position of conveyor band 25 is shown in full lines in FIG. 2. It will be understood that the waste material storage may be effected in any desired pivotal position of conveyor band 25 by switching drive 27 off or by reducing its speed. Also, as shown by arrow 42, conveyor band 25 may be pivoted to the side of the track opposite to electric pole 41.

With this drive control for the storage and conveyor band, the operation of the conveyor arrangement is considerably simplified and made more dependable. Thus, in the illustrated operation along an electrified track section, the operator needs to actuate only a single control for pivoting the conveyor band towards its centered position when the discharge end of the conveyor band approaches an electric pole, the conveyor band drive being switched off automatically in response to this lateral displacement, while this single control will swing the conveyor band out again and switch the conveyor band drive on when the electric pole has been passed.

FIG. 3 illustrates the operation of ballast cleaning machine 1 and its conveyor arrangement 18 in electrified track section 43 along which electric poles 44 to 47 are equidistantly spaced. At the left of FIG. 3, the machine operates with swung out, continuously driven storage and conveyor band 25 discharging the waste material continuously to produce waste dump 39 alongside the track between electric poles 44 and 45. At pole 45, the storage and conveyor band is swung in to avoid a collision with the pole, the lateral inward displacement of the storage and conveyor band automatically switching off its drive to cause the waste material delivered by elongated conveyor band 21 to be temporarily stored in container 26 of the storage and conveyor band. Therefore, no waste material is deposited in the neighborhood of pole 45. Another waste dump is then formed between electric poles 45 and 46 by again swinging conveyor band 25 out while switching on its drive. This is interrupted at pole 46 in the above-described manner and then resumed again to form a short waste dump until an elongated fixed object 48, for example a warehouse, is reached. No waste can be dumped alongside the track in the range of object 48. Therefore, to enable the ballast cleaning machine to continue its operation uninterrupted, storage and conveyor band 25 is pivoted into its centered position (also shown in full lines in FIG. 2) so that it may discharge the waste material without interruption at station 34. Conveyor band drive 27, which was briefly switched off during the lateral displacement of storage and conveyor band 25 from its swung-out to its centered position, is automatically switched on again in the centered position so that the waste material may be continuously discharged and loaded in containers 37. After the machine has passed object 48 and subsequent pole 48, storage and conveyor band 25 of the conveyor arrangement may again be operated in the above-described manner.

What is claimed is:

1. A conveyor arrangement for bulk material, the conveyor arrangement being mounted on a track for mobility therealong in an operating direction and comprising a track-bound vehicle extending longitudinally in said direction, a conveyor means arranged on the vehicle for receiving the bulk material and extending in said direction, the conveyor means comprising a bulk material storage and conveyor band having an input end arranged to receive the bulk material, a storage container for the received bulk material at the input end, the container being open on top and extending in the direction of conveyance of the bulk material, a drive for the conveyor band, a drive control for adjusting the speed of the conveyor band between a maximum and zero whereby conveyance of the bulk material on the conveyor band may be selectively shut off or slowed for temporary storage of the bulk material thereon, and a continuously driven conveyor band arranged to feed the bulk material to the conveyor band inlet end and into the storage container.

2. The conveyor arrangement of claim 1, further comprising a bulkhead extending transversely to said conveyance direction in the storage container, the bulkhead having a lower edge spaced from the conveyor band.

3. The conveyor arrangement of claim 1, wherein the conveyor band has an output end for discharging the bulk material, and further comprising a substantially vertical pivot supporting the input end of the conveyor band on the vehicle, a drive for pivoting the conveyor band about the vertical pivot whereby the conveyor band output end is displaced laterally for discharging the bulk material laterally of the track, and means for switching the conveyor band drive on or off in response to the lateral displacement of the conveyor band.

4. The conveyor arrangement of claim 3, wherein the conveyor band drive switching means comprises a control element connected to the pivoting drive.

5. The conveyor arrangement of claim 1, in a ballast cleaning machine comprising means for excavating ballast supporting the track and for separating the excavated ballast into a cleaned ballast component and a waste material component, the conveyor means being arranged to receive the waste material component as said bulk material, and a station including a container for the waste material component arranged to receive the waste material component discharged from the conveyor band.

* * * * *